US007460787B2

(12) United States Patent
Damink et al.

(10) Patent No.: US 7,460,787 B2
(45) Date of Patent: Dec. 2, 2008

(54) COMMUNICATION SYSTEM WITH EXTERNAL SYNCHRONISATION

(75) Inventors: Paulus Henricus Antonius Damink, Eindhoven (NL); Sel Brian Colak, Eindhoven (NL); Maurice Herman Johan Draaijer, Eindhoven (NL); Maurice Leonardus Anna Stassen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 268 days.

(21) Appl. No.: 10/555,399

(22) PCT Filed: May 5, 2004

(86) PCT No.: PCT/IB2004/050590

§ 371 (c)(1), (2), (4) Date: Nov. 2, 2005

(87) PCT Pub. No.: WO2004/100407

PCT Pub. Date: Nov. 18, 2004

(65) Prior Publication Data

US 2006/0263086 A1 Nov. 23, 2006

(30) Foreign Application Priority Data

May 7, 2003 (EP) ..... 03101260

(51) Int. Cl.
*H04B 10/00* (2006.01)

(52) U.S. Cl. ..... 398/128; 398/130

(58) Field of Classification Search ..... 398/128, 398/130

See application file for complete search history.

(56) References Cited

U.S. PATENT DOCUMENTS

2002/0045434 A1 4/2002 Masoian

FOREIGN PATENT DOCUMENTS

| | | |
|---|---|---|
| EP | 0582998 A1 | 2/1994 |
| WO | 0004660 A2 | 1/2000 |
| WO | 0025456 A1 | 5/2000 |

*Primary Examiner*—Fayez G Assaf

(57) ABSTRACT

In an optical communication method, an accurate common clock signal (GPS) is provided to a sender (10) and a receiver (20). In the sender, the common clock signal is received, a first clock signal (CLK1) is generated on the basis of said common clock signal, a carrier wave with a predetermined carrier frequency (f) is generated using said clock signal as timing reference, the carrier wave is modulated with a data signal, and the modulated carrier wave is transmitted using a light beam (13). In the receiver, the common clock signal is received, a reference signal having the same frequency (f) as the carrier frequency is generated on the basis of said common clock signal, said optical beam (13) is received, a detection signal is derived from the optical beam, the receiver is tuned to the predetermined carrier frequency (f), and the data signal is derived from the detection signal.

13 Claims, 3 Drawing Sheets

COMMUNICATION SYSTEM WITH EXTERNAL SYNCHRONISATION

The present invention relates in general to a communication system, comprising a transmitter and a receiver, wherein the receiver needs to tune to the send frequency of the sender. The present invention relates specifically to a free space optical communication system, and the invention will hereinafter be explained for such optical communication system, but it is explicitly stressed that the invention is not restricted to free space optical communication systems.

Free space optical communication systems are known per se. An example is described in WO-00/25456. For communication from one station (transmitter) to another station (receiver), the transmitter generates a laser beam which is received by an optical detector of the receiver. For two-way communication, the other station also comprises a transmitter and the one station also comprises a receiver. Normally, transmitter and receiver at a station are combined as a transceiver.

Said publication WO-00/25456 relates to a communication network comprising a plurality transceiver stations, acting as nodes in the network. Data can be communicated from a source station to a target station via a communication path defined by a plurality of intermediate stations.

One problem with optical communication systems is that a communication path between two stations can only exist if there is a free line of sight between the corresponding sender and receiver. If the line of sight is blocked by any cause, the communication path is blocked. In the case of a network, there is a possibility that communication is restored by taking another communication path via (different) intermediate stations. This requires the sending station to direct its optical beam to another receiving station, and it requires the receiving station to direct its receiver to another transmitter. In the mean time, the data flow should continue. To this end, the sending station comprises a data buffer which collects the incoming data, and, as soon as the sending station makes contact to another receiving station, the sending station starts sending data from its buffer. The required size of such data buffer is proportional to time required for the sending station to make contact to the other receiving station Thus, if only for this reason, it is desirable that the contact is established as quickly as possible.

Making contact to a receiver requires that the laser beam is directed to the receiving detector very accurately. The sending station will have information on the position of the receiving detector(s), so the sending station knows or will be able to calculate the direction in which to direct the laser beam. In the said publication WO-00/25456, it is mentioned that initial positioning information can be obtained from GPS signals. However, the slightest deviation from the correct direction may cause the very narrow laser beam to miss the receiving detector. During a process of establishing contact, it will thus be necessary for the sending station to adjust the direction of its laser beam. But a miss is a miss, and the sending station requires adjustment information, telling the sending station into which direction the laser beam should be adjusted.

To this end, it is known during a process of establishing contact, to use a broad, i.e. a diverging laser beam, having an intensity maximum at the beam axis, the intensity decreasing with increasing distance from the beam axis. With such a broad beam, it is likely that the beam will "hit" the receiving detector. The beam is swept in two orthogonal directions, typically horizontally and vertically, and the receiving station notes at which directions the received laser power is at a maximum. The receiving station communicates these directions to the sending station, for instance over an RF communication channel. The sending station uses the directional information received from the receiving station to redirect the laser beam, and to narrow the laser beam. If necessary, the above steps may be repeated.

Thus, during such "aiming" process, the receiving station only receives laser light at a substantially reduced power level, so that noise signals may become to play an important disturbing role. Thus, there is a desire to increase the receiver's sensitivity for the laser beam.

Another aspect regards the distance between sending station and receiving station. If a communication network is to cover a large area, a plurality of transceivers is necessary, which is rather costly. The hardware costs of the communication network can be reduced, or a larger area can be covered at the same costs, or both, if the mutual distance between the transceivers can be reduced. As a pay-off, the level of the laser power at a more remote receiving station will be less. So, in order to allow optical communication over a larger distance, without necessarily increasing the laser output power, it is desirable to increase the receiver's sensitivity for the laser beam.

Another aspect relates to a situation where it is desirable that data transmitted by one sending station is received by a plurality of receiving stations of a communication network. According to the state of the art the narrow laser beam of the sending station is directed to and received by only one receiving station. In order for the data to reach a second receiving station, the first receiving station in turn acts as a sending station with respect to the second receiving station, and repeats the transmission of the data. Thus, the data "hops" from station to station, which reduces the overall data transmission capacity of the network, and which requires much more time than when the data would be transmitted optically from the first sending station to all intended receivers directly. In the design according to the state of the art, such direct multiple transmission would only be possible if the first sending station were equipped with multiple transmitters, each directed to a corresponding one of the intended receivers.

Another aspect is a safety aspect Laser light may be hazardous, especially to the eye. Therefore, especially if the communication network is to operate in a residential area, it is desirable to operate the transmitters with as low a laser power as possible. Therefore, also for this reason, it is desirable to increase the receiver's sensitivity for the laser beam.

It is noted that the aspects of increased communication distance and eye safety also play a role in communication systems with fixed transceivers, and even in communication systems with only two stations.

Thus, it is an important objective of the present invention to provide a communication system wherein the receiver's sensitivity is increased.

A further aspect of a communication system relates to the tuning procedure at the side of the receiving station Generally, the receiving station knows at which frequency the transmitter of the sending station should be operating, so it should be possible to filter the incoming signal with a narrowband pass filter in order to eliminate undesired signal components. However, taking tolerances into account, the bandwidth of such bandpass filter can not be too small. In the state of the art, tuning involves the use of a phase-locked loop to tune the receiver circuit to the received signal, which involves the need of additional electronic components.

Thus, it is an important objective of the present invention to provide a communication system wherein the receiver can be tuned to the transmitted signal without a phase-locked loop being necessary.

It is a further important objective of the present invention to provide a communication network comprising at least one sending station and a plurality of receiving stations, wherein the sending station is capable to address all receiving stations simultaneously in an efficient manner.

According to an important aspect of the present invention, a transmitter and a receiver of a communication system are each provided with very accurate timing signals, so that the transmitter and the receiver each can determine very accurately the frequency of the transmitted signal and the frequency to which the receiver is tuned, respectively, to such extent that the receiver is intrinsically tuned very accurately to the transmitter, so that a phase-locked loop can be omitted.

Preferably, said very accurate timing signals originate from a common source. In a preferred embodiment, the transmitter and the receiver each have a GPS receiver for receiving GPS signals, which include very accurate time signals, as will be known to a person skilled in the art.

According to a further important aspect of the present invention, the output power of the transmitted laser beam is distributed over a plurality of receivers. The transmitted laser beam may be a broad, diverging beam covering said plurality of receivers. It is also possible that the transmitted laser beam is split into a plurality of laser beams, each directed to a corresponding receiver.

These and other aspects, features and advantages of the present invention will be further explained by the following description with reference to the drawings, in which same reference numerals indicate same or similar parts, and in which.

Figure 1:
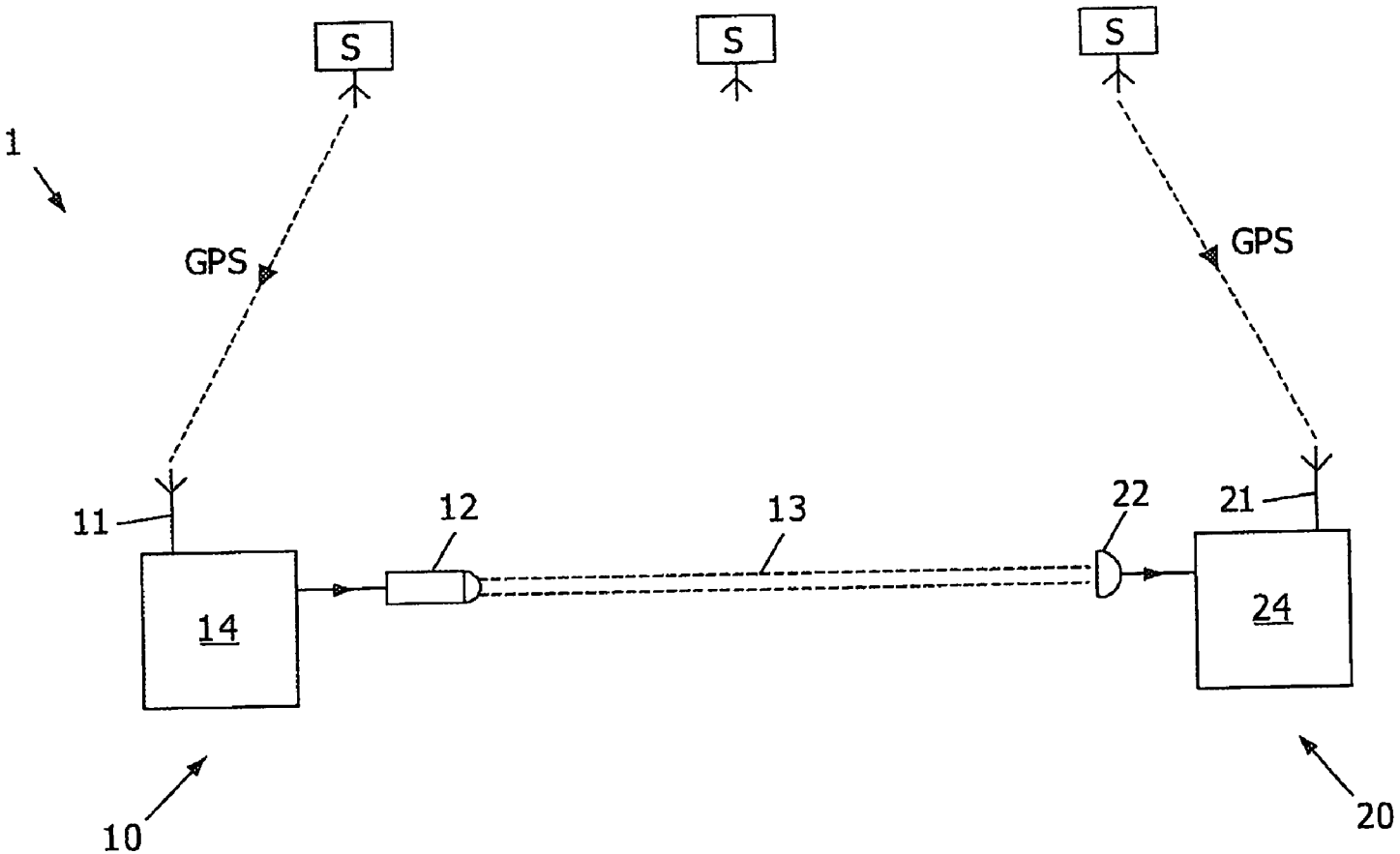
FIG. 1 is a diagram schematically illustrating an embodiment of a communication system according to the invention.

FIG. 1 schematically shows a communication system 1, comprising at least one send station 10 and at least one receiving station 20.

Figure 2A:
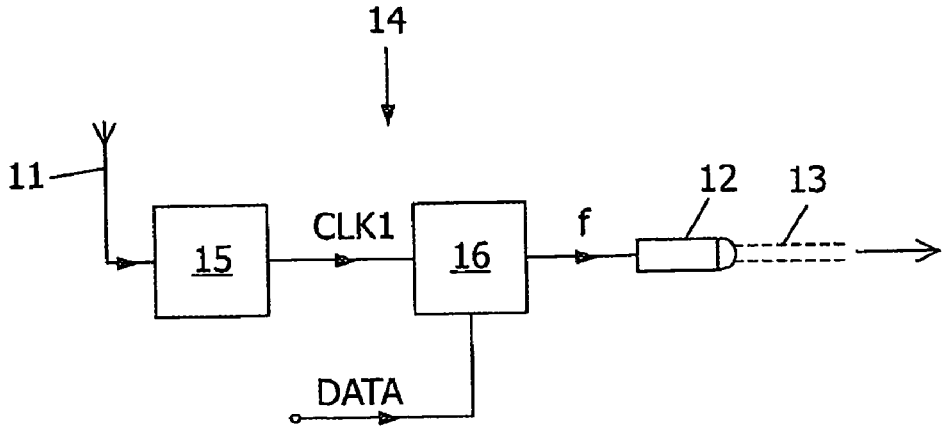
FIG. 2A is a block diagram schematically illustrating an embodiment of a send station according to the invention.

The send station 10 comprises transmission processing circuitry 14 which, through a GPS antenna 11, receives GPS signals from at least one GPS satellite S. FIG. 2A is a block diagram illustrating an embodiment of the transmission processing circuitry 14 in more detail The transmission processing circuitry 14 comprises a clock signal generator 15 adapted to generate a first clock signal CLK1, using the timing information in the GPS signal as timing reference, so that the first clock signal CLK1 will have a very accurate predetermined clock frequency.

The send station 10 further comprises a laser device 12, adapted to generate a narrow laser beam 13. The transmission processing circuitry 14 comprises a laser driver 16, which receives the very accurate first clock signal CLK1. On the basis of the very accurate first clock signal CLK1, the laser driver 16 generates a carrier wave with a very accurate predetermined carrier frequency f, which carrier frequency is transferred by the laser beam 13. The laser driver 16 also receives a data signal DATA, from any suitable source not shown for sake of simplicity. The laser driver 16 is adapted to modulate the said carrier wave with the data signal DATA.

Figure 2B:
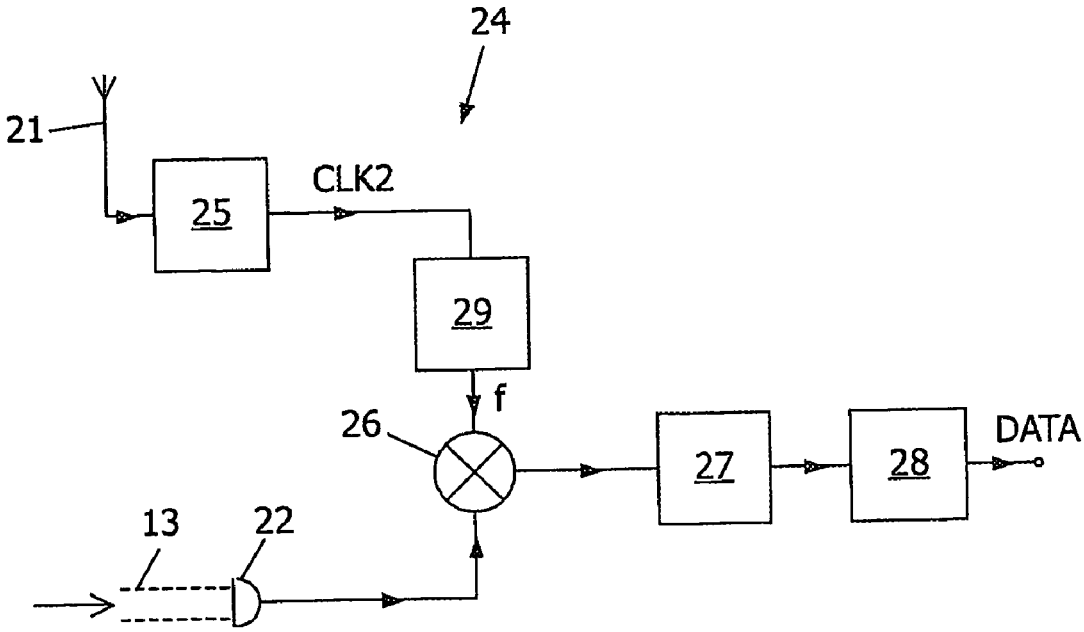
FIG. 2B is a block diagram schematically illustrating an embodiment of a receiving station according to the invention.

The receiving station 20 comprises receiving processing circuitry 24 which, through a GPS antenna 21, receives GPS signals from at least one GPS satellite S. This may be the same GPS satellite as the one from which the transmission processing circuitry 14 receives GPS signals, but this is not necessary. FIG. 2B is a block diagram illustrating an embodiment of the receiving processing circuitry 24 in more detail. The receiving processing circuitry 24 comprises a clock signal generator 25 adapted to generate a second clock signal CLK2, using the timing information in the GPS signal as timing reference, so that the second clock signal CLK2 will have a very accurate predetermined clock frequency. Suitably, but not essentially, the frequency of the second clock signal CLK2 is equal to the frequency of the first clock signal CLK1.

The receiving processing circuitry 24 further comprises a reference signal generator 29, receiving the very accurate second clock signal CLK2, and adapted to generate a reference signal having the same frequency f as the carrier signal of the send station 10. It is noted that the clock signal generator 25 and the reference signal generator 29 may be combined into one circuit.

The receiving station 20 further comprises an optical detector 22, suitable to receive the laser light of laser beam 13 and to generate an output signal corresponding to the light power received. In the embodiment of system 1 as illustrated in FIG. 1, the laser beam 13 is a narrow beam, and the detector 22 receives a relatively large portion of the emitted laser power.

The receiving processing circuitry 24 further comprises a frequency multiplier 26, receiving the said reference signal and the detector output signal as input signals. As will be clear to a person skilled in the art, the multiplier 26 provides an output signal having a frequency equal to the difference between the frequency of the detector output signal and the frequency f of the reference signal. In other words, all frequency components of the detector output signal are shifted to lower frequencies over a frequency distance f.

The frequency of the reference signal corresponds very accurately to the frequency of the carrier signal (with an accuracy in the order of $10^{-12}$-$10^{-15}$); thus, without the need for a phase-locked loop, the reference signal is actual very accurately locked to the carrier signal. Consequently, the multiplier 26 converts the signal of interest (i.e. a signal having the carrier frequency) to a signal having a frequency of approximately zero Hz. Signal components not belonging to the signal as transmitted by the send station 10 will be transformed to signal components in the multiplier output signal having frequency components larger than zero. These noise signals or otherwise disturbing signals can very effectively be filtered out by a relatively simple and low-cost low-pass filter 27 having a relatively low cut-off frequency.

The thus filtered signal is then demodulated by a demodulator 28, which provides the data signal DATA as output signal.

In view of the fact that the receiving station 20 "knows" very accurately which carrier frequency to expect, and in view of the fact that the receiving station 20 is capable to very accurately tune to this carrier frequency, the receiving station 20 is very sensitive to signals in a very narrow band around the carrier frequency.

Figure 3:
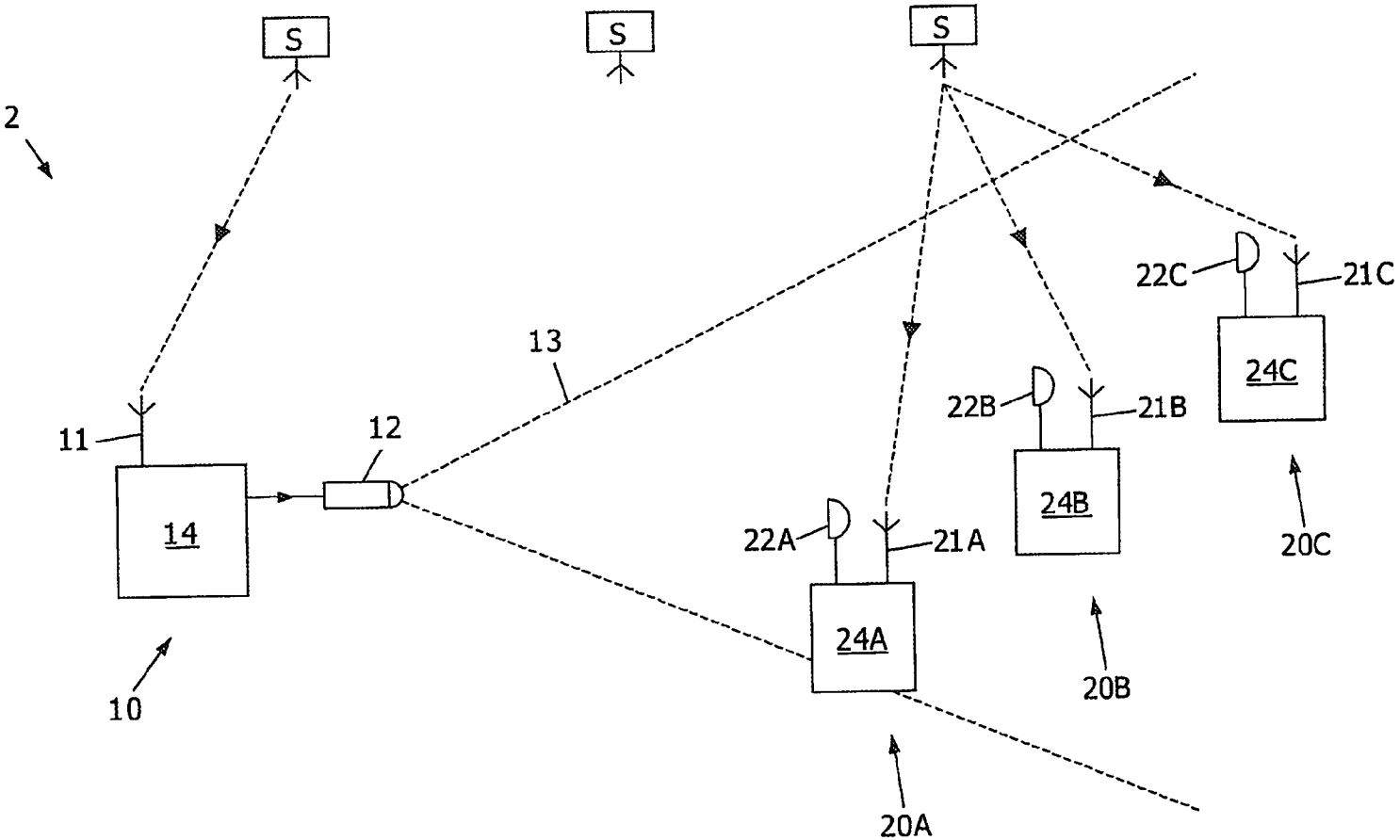
FIG. 3 is a diagram schematically illustrating another embodiment of a communication system according to the invention.

FIG. 3 shows an embodiment of a communication system 2 according to the present invention, comprising at least one send station 10 and a plurality of receiving stations. In FIG. 3, three receiving stations 20A, 20B, 20C are shown, but the communication system 2 may have more than three receiving stations associated with one (or more) send stations. Each receiving station may be identical to the receiving station 20 described in the above.

Characteristic for the communication system 2 is the fact that the laser device 12 of the send station 10 is designed to generate a relatively wide beam 13, covering all optical detectors 22A, 22B, 22C of the receiving stations 20A, 20B, 20C.

So, each optical detector only receives a relatively small portion of the power in the laser beam 13.

In the embodiment as illustrated in FIG. 3, much of the laser power is wasted in that it does not reach any optical detector. It is noted that, alternatively, the laser beam 13 may be split into a suitable plurality of narrow laser beams, each directed to a corresponding optical detector; in that case, too, the optical detectors receive only a portion of the laser beam power.

In this context, it should be noted that the optical power as received by the optical detectors is less if the distance between send station and receiving station is increased, as will be clear to a person skilled in the art.

Nevertheless, in view of the very accurate tuning by each of the receiving stations and the high sensitivity obtained, the receiving stations are capable of reliably deriving the DATA from the optical signal as received.

It should be clear to a person skilled in the art that the present invention is not limited to the exemplary embodiments discussed above, but that several variations and modifications are possible within the protective scope of the invention as defined in the appending claims.

For instance, the above describes that first and second clock signals are generated or derived from the common clock signal. The common clock signal may have a relatively low frequency with a very accurate timing whereas the first and second clock signals derived therefrom may have a higher frequency, accurately synchronised by the common clock signal. It is noted that, in some cases, it is acceptable if the timing of the common clock signal is less accurate, since deviations from the exact timing will have the same effect in both sender and receiver.

Alternatively, it is also possible that the common clock signal has a suitable frequency, so that the frequency of the first and second clock signals may be identical to the frequency of the common clock signal. In that case, the first and second clock signals may be identical to the common clock signal, and it is not necessary to generate separate clock signals. However, in a suitable embodiment, the common clock signal is provided from a common source (e.g. satellite(s)), this common clock signal also being used for other purposes, possibly by other communication systems according to the present invention which, in order to avoid interference, are tuned to operate at different transmission frequencies, so that, in general, the transmission frequency will not be identical to the frequency of the common clock signal.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. Communication method, comprising the steps of:

providing an accurate common clock signal to a sender (10) and a receiver (20);

in the sender, receiving the common clock signal, generating a carrier wave with a predetermined carrier frequency (f) using said common clock signal as timing reference, modulating the carrier wave with a data signal, and transmitting the modulated carrier wave using an optical light beam (13);

in the receiver, receiving the common clock signal, receiving said optical beam (13), deriving a detection signal from the said optical beam, generating a reference signal having the same frequency (f) as the said carrier frequency using said common clock signal as timing reference, tuning to the predetermined carrier frequency (f), and deriving the data signal from the said detection signal;

wherein the step of tuning to the predetermined carrier frequency (f) comprises the steps of: multiplying said detection signal with said reference signal, filtering the multiplied signal with a lowpass filter, and demodulating the filtered signal.

2. Communication method according to claim 1, comprising the steps of:

in the sender, generating a first clock signal (CLK1) on the basis of said common clock signal, and generating the transmission signal using said first clock signal as timing reference;

in the receiver, generating a second clock signal (CLK2) on the basis of said common clock signal, and processing the detection signal using the second clock signal as timing reference.

3. Communication method according to claim 1, wherein the said common clock signal is the timing reference of a GPS signal.

4. Optical communication system (1; 2) for performing the method of claim 1.

5. Optical communication system according to claim 4, comprising:

at least one sending station (10) comprising receiving means (11) for receiving a common clock signal (GPS), and a light source (12) for emitting a light beam (13);

at least one receiving station (20; 20A, 20B, 20C) comprising receiving means (21) for receiving the common clock signal (GPS), and an optical detector (22) for receiving the light beam (13).

6. Optical communication system according to claim 5, wherein the said common clock signal is the timing reference of a GPS signal.

7. Optical communication system according to claim 5, wherein the sending station comprises:

processing circuitry (14) for generating a transmission signal using as timing standard said common clock signal (GPS) or a first clock signal (CLK1) derived therefrom;

wherein said at least one receiving station comprises:

processing circuitry (24) for processing a detector (22) output signal using as timing standard said common clock signal (GPS) or a second clock signal (CLK2) derived therefrom.

8. Optical communication system according to claim 7, wherein the sending station comprises:

processing circuitry (14) for generating a data carrying signal having a predetermined carrier frequency (f) using as timing standard said common clock signal (GPS) or a first clock signal (CLK1) derived therefrom, the processing circuitry (14) being adapted to modulate said light beam (13) with said data carrying signal;

wherein said at least one receiving station comprises:

processing circuitry (24) for tuning to said predetermined carrier frequency (f) and for deriving said data carrying signal from said light beam (13), using as timing standard said common clock signal (GPS) or a second clock signal (CLK2) derived therefrom.

9. Communication system according to claim 8, wherein the sending station (10) comprises:

an antenna (11) for receiving the said common clock signal;

a clock signal generator (15) receiving an output signal from said antenna (11), and adapted to generate a first clock signal (CLK1) on the basis of said antenna output signal; a light source driver (16) receiving said first clock signal (CLK1) and adapted to receive a data signal, the driver (16) being adapted to generate a carrier wave with a predetermined carrier frequency (f), to modulate the carrier wave with the data signal, and to drive the light source (12) with the modulated carrier wave.

10. Communication system according to claim 8, wherein the receiving station (20) comprises:

an antenna (21) for receiving the said common clock signal;

a clock signal generator (25) receiving an output signal from said antenna (21), and adapted to generate a second clock signal (CLK2) on the basis of said antenna output signal;

a reference signal generator (29) receiving said second clock signal (CLK2), and adapted to generate a reference signal having the said predetermined carrier frequency (f) on the basis of said second clock signal (CLK2).

11. Communication system according to claim 10, wherein the clock signal generator (25) and the reference signal generator (29) are implemented as one combined unit.

12. Communication system according to claim 10, wherein the receiving station (20) further comprises:

a frequency multiplier (26) receiving an output signal from said optical detector (22) and receiving said reference signal.

13. Communication system according to claim 12, wherein the receiving station (20) further comprises:

a low-pass filter (27) receiving an output signal from said frequency multiplier (26), and a demodulator (28) receiving an output signal from said low-pass filter (27).

* * * * *